US005084648A

United States Patent [19]

Holten

[11] Patent Number: 5,084,648

[45] Date of Patent: Jan. 28, 1992

[54] ELECTRIC REFLECTOR LAMP

[75] Inventor: Petrus A. J. Holten, Weert, Netherlands

[73] Assignee: U.S. Philips Corporation, New York, N.Y.

[21] Appl. No.: 553,478

[22] Filed: Jul. 13, 1990

[30] Foreign Application Priority Data

Jul. 27, 1989 [NL] Netherlands ..... 8901945

[51] Int. Cl.[5] ..... H01J 5/16; H01K 1/32

[52] U.S. Cl. ..... 313/113; 313/114

[58] Field of Search ..... 313/113, 114

[56] References Cited

U.S. PATENT DOCUMENTS

| | | | |
|---|---|---|---|
| 2,059,033 | 10/1936 | Rivier | 313/114 X |
| 4,506,185 | 3/1985 | Giller et al. | 313/113 |
| 4,633,126 | 12/1986 | Giller et al. | 313/113 |
| 4,788,469 | 11/1988 | Holten | 313/113 |
| 4,803,394 | 2/1989 | Holten | 313/113 |

*Primary Examiner*—Palmer C. DeMeo
*Attorney, Agent, or Firm*—Robert J. Kraus

[57] ABSTRACT

The reflector lamp with lamp vessel (1), whose second portion (8) and third portion (11) are mirror-coated and form cooperating reflector portions, has an axially positioned light source (15) which extends in front of and behind the greatest diameter (3). The lamp forms a beam with a high luminous flux and a high luminous intensity in the beam center.

2 Claims, 1 Drawing Sheet

ELECTRIC REFLECTOR LAMP

BACKGROUND OF THE INVENTION

The invention relates to an electric reflector lamp provided with:

a rotationally symmetrical lamp vessel comprising:

- an axis of symmetry and a greatest diameter transverse to this axis,
- a neck-shaped first portion behind the greatest diameter, which portion carries a lamp cap provided with contacts,
- a mirror-coated second portion which extends between the first portion and the greatest diameter and merges fluently into the first portion, which second portion extends in a direction transverse to rather than longitudinally along the axis and is, in axial cross-section, substantially curved according to a circular arc whose centre of curvature lies in front of the greatest diameter in a region extending away from the axis of symmetry,
- a mirror-coated third portion which merges fluently into the second portion and which extends in front of the greatest diameter in a direction longitudinally along rather than transverse to the axis of symmetry, which third portion, in axial cross-section, is substantially curved according to a circular arc whose centre of curvature lies behind the greatest diameter at the other side of the axis of symmetry,
- opposite the first portion, a translucent fourth portion adjoining the third portion,
- a light source arranged around the axis of symmetry near the greatest diameter,
- current supply conductors extending from the light source to contacts at the lamp cap.

Such a lamp is known from U.S. Pat. No. 4,788,469.

The lamp vessel of the known lamp has a shape which renders it suitable for being provided with various coatings in order to obtain a lamp which is suitable for one of various applications each time. An important application is that of a reflector lamp, which is obtained by providing the second and the third portion of the lamp vessel with a mirror coating. The object of this lamp is to provide a light beam with a high luminous flux and a high luminous intensity in the beam centre.

The lamp vessel of the known lamp was specifically designed for a helical incandescent body as the light source, which body is arranged transversely near the greatest diameter, bent around the axis of symmetry. The centre of curvature of the circular arc according to which the second portion of the lamp vessel is curved and said circular arc itself are on opposing sides of the axis of symmetry is this case.

SUMMARY OF THE INVENTION

It is an object of the invention to provide a reflector lamp of the kind described in the opening paragraph which achieves a light beam with a higher luminous flux and a higher luminous intensity in the beam centre.

According to the invention, this object is achieved by a lamp of the kind mentioned in the opening paragraph in that the light source is arranged axially and extends on either side of the greatest diameter and the centre of curvature of the second portion of the lamp vessel lies in a region which extends on either side of the axis of symmetry.

Because the lamp vessel of the known lamp was specifically designed for incorporating an incandescent body in a plane transverse to the axis of symmetry and coinciding with the greatest diameter, bent around this axis, it was a surprise to find that a higher luminous flux in the beam and a higher luminous intensity in the beam centre are obtained when the light source is arranged axially, extending on either side of the greatest diameter. In addition, the light beam has a greater uniformity.

The axial position of the light source means that not only an incandescent body is suitable to form the light source, but also a high-pressure gas discharge, for example a high-pressure sodium vapour discharge, whose discharge path extends axially in the lamp vessel.

It was found that, while an identical light source was used, an even higher luminous flux with an even higher luminous intensity in the beam centre is obtained when a lamp vessel is used in which the centre of curvature of the circular arc of the second portion of the lamp vessel is at the same side of the axis of symmetry as the associated circular arc.

BRIEF DESCRIPTION OF THE DRAWING

Embodiments of the reflector lamp according to the invention are shown in the drawing, in which.

DESCRIPTION OF THE PREFERRED EMBODIMENT

Figure 1:
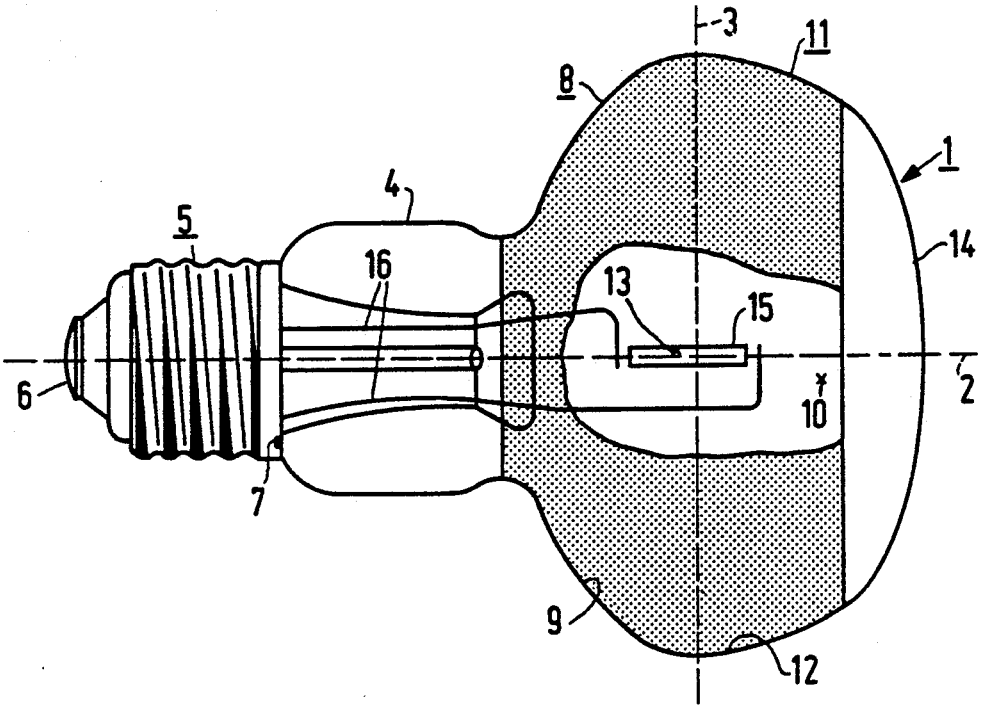
FIG. 1 is a side elevation of a first embodiment with the lamp vessel partly broken away.

The reflector lamp of FIG. 1 has a rotationally symmetrical lamp vessel 1 with an axis of symmetry 2 and a greatest diameter 3 transverse to this axis. The lamp vessel 1 has a neck-shaped first portion 4 behind the greatest diameter 3, which portion carries a lamp cap 5 provided with contacts 6, 7. A mirror-coated second lamp vessel portion 8 extends between the neck-shaped portion 4 and the greatest diameter 3 in a direction transverse to rather than longitudinally along the axis. In axial cross-section it is substantially curved according to a circular arc 9 whose centre of curvature 10 lies in front of the greatest diameter 3 in a region adjacent the axis of symmetry 2. A mirror-coated third lamp vessel portion 11 merges fluently into the second portion 8 and extends in front of the greatest diameter 3 in a direction longitudinally along rather than transverse to the axis of symmetry 2. In axial cross-section it is substantially curved according to a circular arc 12 whose centre of curvature 13 lies behind the greatest diameter 3 at the other side of the axis 2 than does the circular arc 12. Opposite the neck-shaped portion 4 there is a fourth, translucent portion 14 of the lamp vessel 1 which adjoins the third portion 11.

A light source 15 is arranged around the axis of symmetry 2 near the greatest diameter 3. Current supply conductors 16 extend from the light source 15 to the contacts 6, 7 at the lamp camp 5.

The light source 15, a helically coiled incandescent body in the drawing, is positioned axially and extends on either side of the greatest diameter. The centre of curvature 10 of the circular arc 9 of the second lamp vessel portion 8 lies in a region which is off of the axis of symmetry 2, i.e. in FIG. 1 in a region which is disposed adjacent the axis 2 on the same side of the axis as the circular arc 9.

Figure 2:
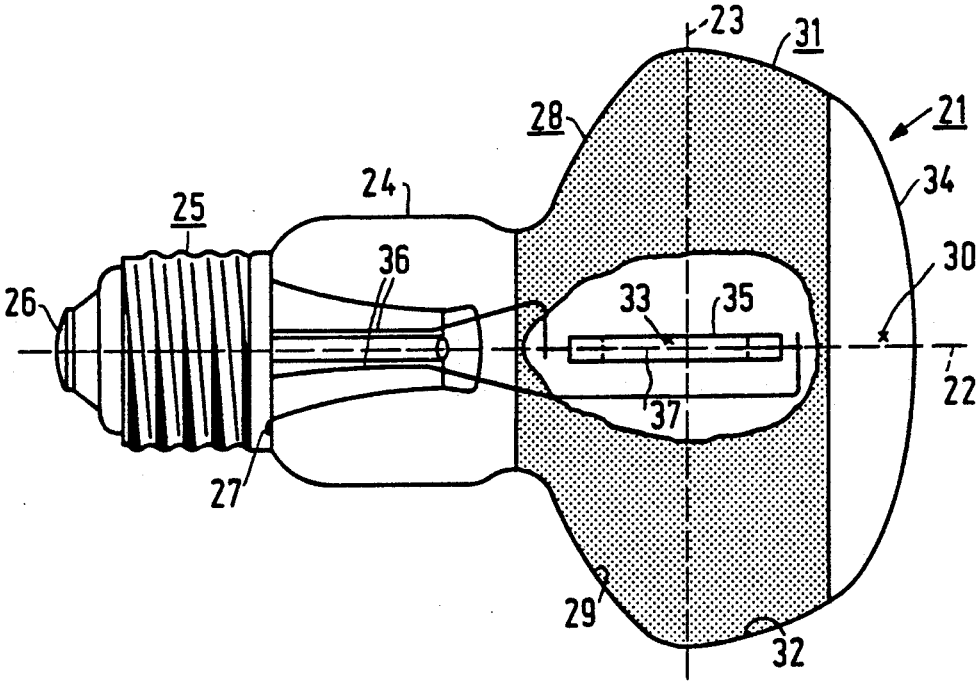
FIG. 2 is a side elevation of a second embodiment with the lamp vessel partly broken away.

In FIG. 2 corresponding parts have reference numerals which are 20 higher than those in FIG. 1. In this figure the light source 35 is a high-pressure sodium vapour discharge lamp whose discharge path 37 extends in axial direction. The centre of curvature 30 of the circular arc 29 lies on the opposite side of the axis of symmetry 22 than the circular arc 29.

In the lamp according to the invention, the second portion 8, 28 reflects incident light to the fourth portion 14, 34 which acts as a window, without the third portion 11, 31 forming a substantial obstacle to this. Light thrown directly onto the third wall portion 11, 31 is cut off by that portion so that it cannot emerge under a wide angle with the axis 2, 22. The third portion 11, 31 reflects the said light to the second portion 8, 28, which then throws it to the exterior through the window without the third portion 11, 31 forming a substantial obstacle to this. Added to these two quantities of light emerging through the window is the light radiated directly towards the window by the light source 15, 35.

The third portion 11, 31, therefore, has a multiple function:

intercepting light which would leave the lamp vessel under too wide an angle with the axis, i.e. narrowing the light beam, reflecting this light to the second portion in order to add it to the beam formed by this portion, allowing the beams reflected by the second portion to pass.

An important advantage of the axial position of the light source of the lamp according to the invention is that the application of a high-pressure gas discharge by way of light source is made possible by it. These light sources have a higher luminous efficacy than incandescent bodies.

A number of lamps, all having a 120V 60W incandescent body were compared with one another photometrically. A lamp having a conventional paraboloid lamp vessel was taken as a reference. The results are shown in table I.

TABLE I

| Lamp | Lamp vessel | Incandescent body | Io (cd) | S (°) | ϕ30 (lm) |
|---|---|---|---|---|---|
| a | FIG. 2 | transversal | 100% | 25 | 120% |
| b | FIG. 2 | axial | 135% | 18 | 135% |
| c | FIG. 1 | transversal | 85% | 30 | 120% |
| d | FIG. 1 | axial | 150% | 18 | 150% |
| e | parabol. | axial | 100% | 18 | 100% |

In this table, Io represents the luminous intensity in the beam centre. S is the apex angle of an imaginary cone in the light beam along whose surface the luminous intensity is 50% of Io. The column ϕ30 (1 m) contains the total luminous flux in a cone of the light beam having an apex angle of 30°.

The table shows that, if the transversely positioned incandescent body is replaced by an axially positioned incandescent body (lamp b) in the known lamp a according to the U.S. Pat. No. 4,788,469 cited, a narrower beam (S=18° instead of 25°) is obtained with a higher luminous intensity in the centre (Io) and a higher luminous flux (ϕ30). The improved lamp of FIG. 1 (lamp d) has an even higher luminous intensity in the centre and an even higher luminous flux. The lamp vessel of FIG. 1 gives a less good result with a transversal incandescent body (lamp c) than does lamp a according to the patent cited. It is evident from this that the lamp a was specifically designed for a transversally positioned incandescent body.

I claim:

1. An electric reflector lamp for producing a light beam having a high central luminous intensity, said lamp comprising an envelope formed around an longitudinal axis of symmetry and including:

a. a neck shaped first portion of the envelope supporting a lamp cap having a plurality of electrical contacts;

b. a reflectively coated second portion of the envelope extending from the first portion to a region where the envelope has a maximum diameter, said second portion extending substantially transversely from the axis and, in axial cross section, defining a substantially circular first arc having a center of curvature disposed at a position which is off of the axis and, with respect to said first arc, is on the opposite side of the maximum diameter;

c. a reflectively coated third portion of the envelope extending from the second portion substantially longitudinally and, in axial cross section, defining a substantially circular second arc having a center of curvature disposed at a position which is off of the axis and, with respect to said second arc, is on the opposite sides of both the axis and the maximum diameter;

d. a light transmissive fourth portion of the envelope extending from the third portion to the axis; and e. a light source arranged around the axis of symmetry and extending into both the second and third portions of the envelope, said light source being electrically connected to the electrical contacts of the lamp cap.

2. An electric reflector lamp as in claim 1 where the center of curvature of the first arc is disposed on the same side of the axis as said first arc.

* * * * *